US008378221B2

(12) United States Patent
Bernauer

(10) Patent No.: US 8,378,221 B2
(45) Date of Patent: Feb. 19, 2013

(54) METHOD FOR MANUFACTURING AN ELECTRICAL LEADTHROUGH AND AN ELECTRICAL LEADTHROUGH MANUFACTURED ACCORDING TO SAID METHOD

(75) Inventor: Johann Bernauer, Tiefenbach (DE)

(73) Assignee: Schott AG (DE)

( * ) Notice: Subject to any disclaimer, the term of this patent is extended or adjusted under 35 U.S.C. 154(b) by 618 days.

(21) Appl. No.: 12/333,797

(22) Filed: Dec. 12, 2008

(65) Prior Publication Data

US 2009/0223699 A1 Sep. 10, 2009

(30) Foreign Application Priority Data

Dec. 17, 2007 (DE) ..... 10 2007 061 175

(51) Int. Cl.
*H01B 17/26* (2006.01)

(52) U.S. Cl. ..... 174/152 GM; 29/25.42; 439/926; 174/650

(58) Field of Classification Search ..... 174/152 GM, 174/650; 29/25.42, 25, 42; 439/926, 736; 65/59.1, 32.2, 30.1
See application file for complete search history.

(56) References Cited

U.S. PATENT DOCUMENTS 3,864,112 A * 2/1975 Mattox et al. ..... 65/43
4,176,901 A 12/1979 Ishimaru
5,308,925 A * 5/1994 Paterek et al. ..... 174/152 GM
5,406,444 A * 4/1995 Selfried et al. ..... 361/302
2001/0055930 A1 12/2001 Ott et al.

FOREIGN PATENT DOCUMENTS

| | | |
|---|---|---|
| DE | 1 972 545 | 11/1967 |
| DE | 1 972 545 U | 11/1967 |
| DE | 1 490 508 | 12/1971 |
| DE | 26 04 573 A1 | 8/1977 |
| DE | 28 24 637 C2 | 3/1982 |
| DE | 100 16 108 C2 | 9/2002 |
| GB | 673596 | 6/1952 |

OTHER PUBLICATIONS

German Office Action, German Patent Office dated Jun. 19, 2008.
Evans, Andrew, "EP Application No. 08021508.0 European Search Report Aug. 23, 2011", , Publisher: EPO, Published in: EP.
Yan, Jing, "Chinese Patent Application 200810185937.5 Office Action", Aug. 10, 2012, Publisher: State Intellectual Property Office of the People's Republic of China, Published in: CN.

* cited by examiner

*Primary Examiner* — Dhirubhai R Patel
(74) *Attorney, Agent, or Firm* — Kaplan Breyer Schwarz & Ottesen, LLP

(57) ABSTRACT

The underlying purpose of the invention is to manufacture electrical leadthroughs, which are improved with regard to the temperature resistance thereof. Proposed for this purpose is a method for manufacturing an electrical leadthrough, for which at least one metal tube is fused in a glass insulator, whereby a metal rod is mounted in the metal tube by means of soldering-in, prior to or during the sealing of the tube in the glass insulator.

33 Claims, 2 Drawing Sheets

METHOD FOR MANUFACTURING AN ELECTRICAL LEADTHROUGH AND AN ELECTRICAL LEADTHROUGH MANUFACTURED ACCORDING TO SAID METHOD

FIELD OF INVENTION

The use of electrical leadthroughs in order to conduct currents, voltages or electric signals out of and into hermetically sealed tanks is known. For applications in which high temperatures can have an effect and/or for which a low leakage rate is required, glass is particularly suitable as an insulation material for the electrical conductor or conductors of the leadthrough. Crucial to the imperviousness of such a leadthrough is, among other things, the glass-to-metal transition between the electric conductor and the insulating glass material.

BACKGROUND OF THE INVENTION

The difficulty with this type of leadthrough lies in, among other things, the fact that glass and metal generally have different coefficients of thermal expansion, which can lead to temperature stress and, consequently, to fissures in the glass material. The use of certain alloys, such as iron-nickel alloys in particular, which have a coefficient of temperature expansion matched to the glass, is a known measure for counteracting this problem. However, the problem then emerges that such alloys are not optimal with regard to the conductivity thereof. In order to improve conductivity, particularly in order to carry high current, an electrical leadthrough was manufactured in the past having a metal tube of such an alloy. Then a rod of a material having high conductivity, particularly copper, or brass or bronze was soldered into the tube in a second step.

However, a disadvantage of such a leadthrough is that a reheating when soldering still leads to thermal stress, which then considerably degrades the temperature resistance and long-term stability of such a leadthrough.

SUMMARY OF THE INVENTION

The underlying purpose of the invention therefore is to indicate a method that can be used to manufacture an electrical leadthrough that is improved with regard to the temperature resistance thereof.

Accordingly, the invention provides for a method for manufacturing an electrical leadthrough, for which at least one metal tube is fused in a glass insulator, whereby a rod of a highly conductive metal or metal alloy is hermetically joined to said metal tube prior to or during fusion of said tube in the glass insulation.

The metal rod need not necessarily be solid; it also is possible to use a hollow, tubular rod in order to, for example, accommodate an additional rod or in order to conduct a cooling liquid.

It is particularly preferred to solder the metal rod in the metal tube. In order to ensure a permanent bond even at higher temperatures, it is preferable, in this connection, to use hard solder to solder the metal rod into the metal tube.

Accordingly, it is possible with the method according to the invention to manufacture an electrical leadthrough having at least one conductor, comprising a metal tube and a metallic rod hard-soldered therein, fused in a glass insulator. Relative to known leadthroughs, a leadthrough manufactured according to the invention is distinguished by means of a higher temperature resistance and long-term stability, since a reheating in order to solder the inner metal rod inside the metal tube is eliminated. Such a reheating leads, in other respects, to stress between metal and glass, which leads to microfissures in the glass. Surprisingly, it is possible in this connection, to prolong the soldering process to the generally long duration of the vitrification and to nevertheless achieve a stabile soldering. Thus, the vitrification, or, as the case may be, the sealing of the tube in the glass can be carried out for a duration ranging from minutes to up to 36 h.

In addition, the metal tube and metal rod preferably comprise different materials. Here, in order to then avoid thermal stress, the metal rod is soldered to only one end of the tube in a preferred improvement of the invention.

For the glass-to-metal transition of the leadthrough, it is likewise advantageous to use a metal tube of a material having a coefficient of temperature expansion matched to the glass insulation. Coming into question here as a material for the metal tube are, among others, Ni—Fe alloys. Here, rather than the metal tube having to be composed exclusively of one such alloy, parts of the tube, such as the outer casing thereof, can be fabricated of a material having a matched coefficient of thermal expansion.

For an ability to conduct high current, it is furthermore advantageous if a copper rod is fixed in the metal tube. A suitable copper alloy having a high current conductivity can also be used.

According to yet another improvement of the invention, sealing is carried out—in contrast to a fusion under vacuum or low-pressure conditions—in an environment having a controlled gas atmosphere, particularly under normal pressure conditions. Such a controlled atmosphere can be an inert gas atmosphere, in particular.

The composition of the controlled atmosphere can be determined, in particular, by means of the glass type of the leadthrough and the metals used. Certain glass types and metals can be better processed in reduced or neutral environments. However, a controlled atmosphere can also have an oxidizing effect, in particular. This is of advantage in order to achieve, among other things, a particularly good glass-to-metal transition. Thus, the exterior surface of the metal tube can be oxidized prior to or during the sealing by means of, among other things, a suitable atmosphere. In an oxidizing atmosphere, an oxide layer, which can bond to the glass, forms on the metal tube. A targeted oxidizing of the exterior surface can however also occur by means of other alternative or additional measures. In addition, an oxidizing environment also suppresses or retards a conversion of oxidic components of the glass or metals.

In general, oxidizing gases can be released—even in a neutral or reducing atmosphere as the glass and/or metals of the leadthrough conductors are heated. However, such elements are disadvantageous, particularly for fixing the metal rod in the metal tube by means of soldering. This applies particularly if the metal rod is soldered in without the use of flux, according to a preferred configuration of the invention. An oxidizing atmosphere worsens the wetting of the solder with the components to be joined; moreover, the solder can oxidize in the course of the generally quite long vitrification process and, consequently, can have no wetting or a sharply reduced wetting.

In order to nevertheless enable a soldering-in during the vitrification of the leadthrough, it is provided according to an improvement of the invention that a cap or sleeve that protects the soldering location during the sealing is placed over the metal tube. In particular, the cap or sleeve that protects the soldering location during the sealing can enclose the soldering location during the sealing. With such a cap, oxidizing gases can at least be partially kept away from the mounting location of the tube to the rod during the sealing. In order to further improve the effect of the cap, the cap can also be configured such that the cap absorbs or transforms oxidizing gases during the sealing. Such an effect can be achieved in a surprisingly simple way if the soldering location is protected, in particular, enclosed by a graphite cap or graphite-containing cap.

In order to achieve a protective effect for the soldering location, the cap or sleeve need not be composed exclusively of graphite, even if this embodiment is particularly preferred. It is also conceivable to use, for example, a cap of a fireproof carrier, which is lined or provided with graphite. Thus a metallic or ceramic cap, for instance, can be used which has been coated with graphite. In addition, the material of the cap can also have, in general, a high reaction bonding effect for oxidizing gases, at least in a hot state, i.e., a getter effect.

If a leadthrough is manufactured having several conductors, thus, accordingly, several metal tubes, the several metal tubes can also be covered with a common cap or sleeve. In particular, several metal tubes can also be fused in a common glass insulator.

In a preferred improvement of the invention, a sintered glass body is used, in which the metal tube or tubes are inserted. A sintered body assembled in this way is then melted in order to manufacture an impervious glass-to-metal bond to the metal tube.

In addition, the glass can also be melted in a metal body of the leadthrough, e.g., of a metal sleeve or of a flange, in order to manufacture an impervious bond of the glass with the metal part as a component of the leadthrough. If the glass is melted in the metal body, then an impervious bond results with the glass melted on the metal body. In this connection, alignment elements preferably are used to fix the metal tube in alignment to the metal body during the sealing, in order to obtain a precise alignment of the conductor or conductors to the metal body of the completed electrical leadthrough.

The method according to the invention can be used to solder the metal tube and rod to each other in such a way that the soldering location with which the metal tube and rod are bonded reaches very close to the surface of the glass insulation. Thus, yet another improvement of the invention provides for the soldering location to be arranged even at a distance ranging from 2-20 millimeters away from the glass surface.

A permanent bond is achieved with soldering if the metal tube and rod are bonded with a fillet weld or capillary weld. The fillet weld can preferably also reach in the tube, or, at the end of the tube, bond the inside thereof to the rod.

Among other things, the invention is particularly suitable for the manufacture of an electrical leadthrough for a safety tank. A preferred application is the manufacture of an electrical leadthrough for the reactor safety tank of a nuclear power plant. The invention is also outstandingly suited for manufacturing electrical leadthroughs for pressure or vacuum tanks.

BRIEF DESCRIPTION OF THE DRAWINGS

In the following, the invention will be explained in detail with the aid of embodiments and with reference to the appended drawings. In this connection, identical reference numbers denote identical or similar parts.

Shown are.

DETAILED DESCRIPTION

Figure 1:
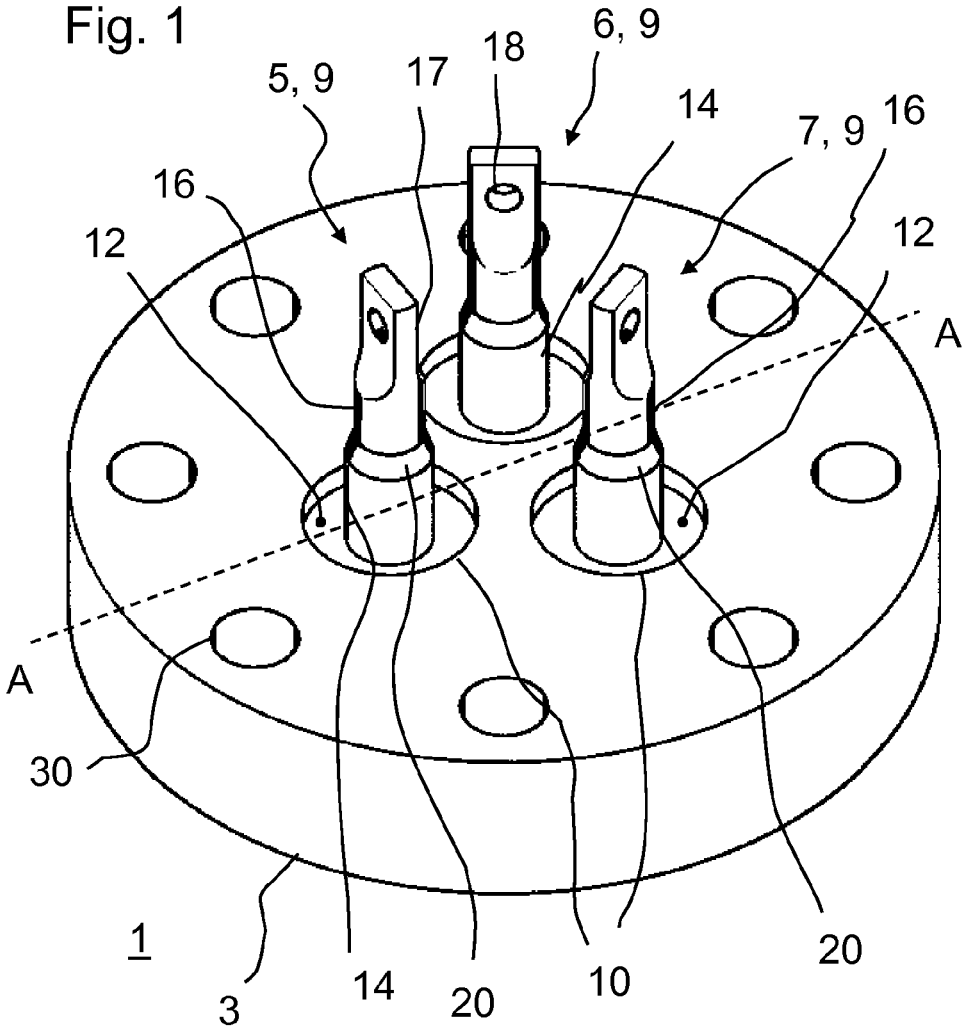
FIG. 1 one view of a leadthrough according to the invention.

Illustrated in FIG. 1 is one embodiment of a leadthrough according to the invention denoted as a whole by the reference number 1.

The leadthrough 1 comprises a metal body configured as a flange 3 having three individual leadthroughs 5, 6, 7. Screw holes 30 in the flange serve to fasten the leadthrough, e.g., to an opening of a safety tank, or of a pressure tank. Such a safety tank can be a reactor safety tank, in particular, of a nuclear power plant.

The individual leadthroughs 5, 6, 7 are arranged, in each case, in boreholes 10 in the flange 3 and comprise, in this embodiment, in each case, one conductor 9, which, with glass insulation 12, is insulated relative to the inner wall of the borehole 10. The conductors 9 comprise, in each case, a metal tube 14 in which a metal rod 16 is inserted and soldered in with hard solder without flux.

In this connection, soldering-in takes place prior to, or preferably during, sealing of the tube 14 in the glass insulation 12. A sealing of the conductors 9 in the glass insulation in the flange is also performed. For this reason, the glass of the insulation is melted to the metal body and a hermetic seal is also created on the inner wall of the borehole 10.

The metal tube 14 is fabricated from a different material than the copper rod 16. In order to improve the temperature resistance and resistance to thermal shock of the electrical leadthrough 1, it is preferable to use a material for the metal tube 14 having a coefficient of temperature expansion matched as closely as possible to the glass insulation 12. A preferred material for this is a nickel-iron alloy.

For this embodiment, the soldering location 20 is designed as a fillet weld, which is formed in the fillet of the exterior surface of the copper rod 16 projecting from the metal tube 14 and the end surface of the metal tube 14. The manufacturing method according to the invention allows the soldering location 20 to be arranged very close to the surface of the glass insulation 12. The distance here lies in a range from 2-20 millimeters.

In order to prevent temperature stress between the parts 14, 16 bonded to each other, a soldering location 20 is provided at only one end of the metal tube 14. The rod 16 can then move at the other end of the tube 14 longitudinally relative to the tube, owing to differing thermal expansion.

In order to connect cables to the conductors 5, 6, 7, the copper rods 16 each have a truncated end 17 having a through-hole 18. In this connection, cables can be fastened to the conductors 5, 6, 7 with a screw connection through the through-holes 18; however, other connecting techniques are also possible.

Figure 2:
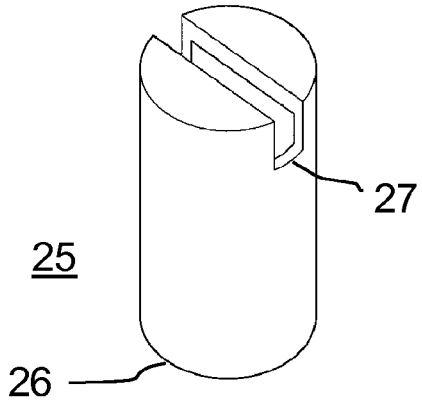
FIG. 2 a sleeve for protecting the soldering location during sealing of the conductor of the leadthrough shown in FIG. 1, FIG. 3 an alignment element for aligning (centering) a conductor during sealing, FIG. 4 a cross-sectional view through the flange having an assembly for sealing the conductor of the leadthrough, and FIG. 5 an arrangement for manufacturing a leadthrough having several conductors in a common glass insulation.

FIG. 2 shows a graphite sleeve 25, which, in each case, is put over the copper rod 16 and metal tube 14 by means of the open end 26, during sealing of the conductors 5, 6, 7, in order to protect the soldering location 20 during sealing. In this embodiment, the closed end of the graphite sleeve has a slot 27, through which the truncated end 17 of the copper rod 16 projects. Alternatively, the sleeve can also be designed to be long enough to accommodate the end of the copper rod 16 projecting out of the metal tube 14, including the truncated end 17, in the sleeve 25.

Figure 3:
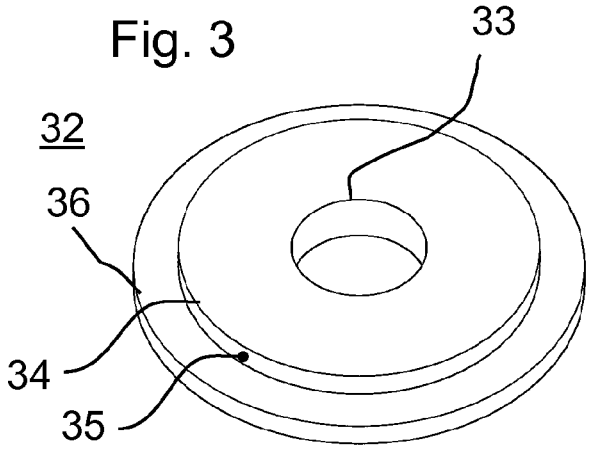

FIG. 3 shows an alignment element 32, with which the metal tube 14 of a conductor 5, 6, 7 is fixed in alignment to the flange 3 during sealing. The alignment element 32 is discoid and has a central, axial borehole 33, by which the alignment element 32 is put over the metal tube 14.

In addition, the alignment element 32 has a flat inner, cylindrical section 34 and a rim 36. The alignment element 32 is placed on the metal tube with the inner section 34 facing toward the opening 10 in the flange. The inner section here is shaped to correspond to the shape of the opening 10, such that the exterior surface 35 of section 24 can be pushed into the opening 10, until the rim 36 is supported against the outside of the flange 3. The borehole 33 and also the metal tube 14 inserted through it are therewith centered relative to the opening 10 of the flange 3. Graphite also is preferably used for the alignment element, since graphite does not adhere to molten glass.

Figure 4:
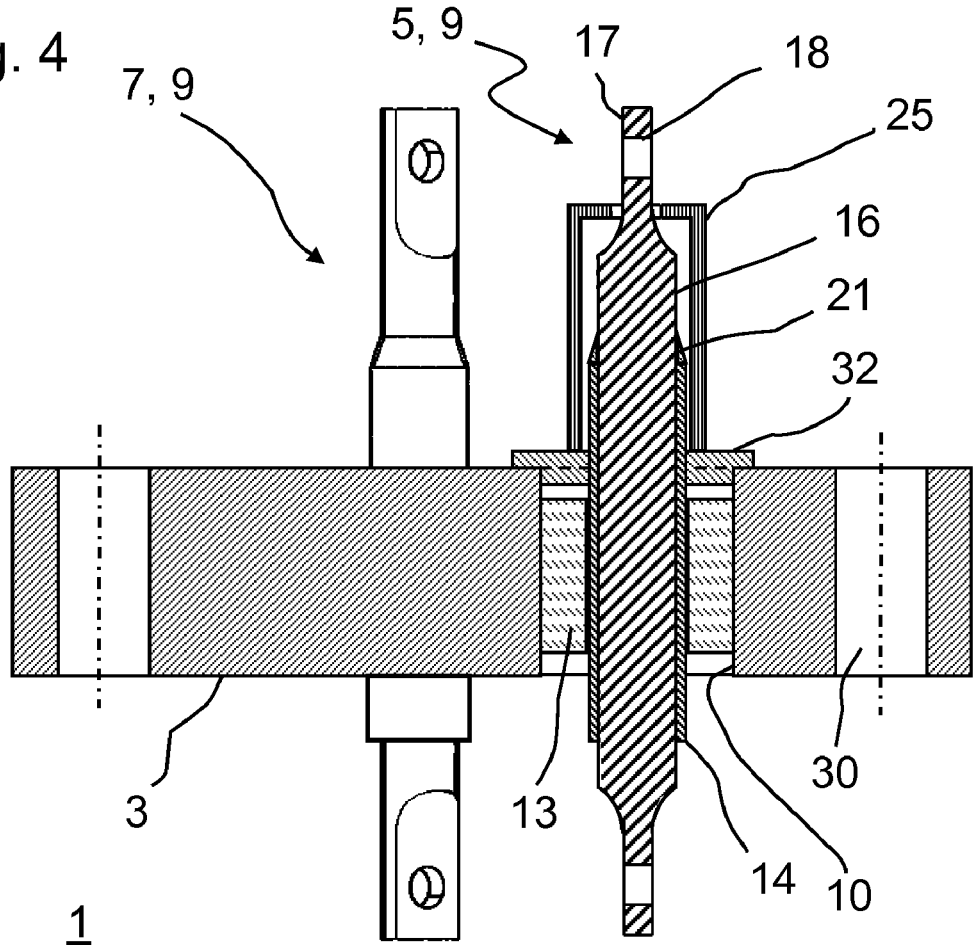

Illustrated in FIG. 4 is a cross sectional view through the flange 3 along line A-A in FIG. 1. Illustrated in said cross section is the assembly with which the conductors 5, 6, 7 are fused in the glass insulation. Glass sintered bodies 13 are placed in the openings 10, and the metal tubes 14 are inserted in openings in the sintered bodies 13. In addition, the copper rods 16 are inserted in the metal tubes 14 and hard solder 21 is deposited in the peripheral fillet formed between the end of the metal tube 14 and the exterior surface of the copper rod 16.

For centering, an alignment element 32 as illustrated in FIG. 3 is placed on the metal tube and anchored in the opening 10, such that the metal tube is axially centered in the opening 10. One or more alignment elements can also be attached to the opposite side of the opening. However, these are not illustrated in FIG. 4 for the sake of clarity.

In addition a graphite sleeve, as represented in FIG. 2, is put over the metal tube, so that the sleeve encloses the soldering location at the fillet. In FIG. 4, only the conductor 5 is illustrated with this type of assembly, for the sake of clarity.

A flange thus equipped is then heated in a controlled-atmosphere furnace under normal pressure conditions, preferably under a slight overpressure. The composition of the atmosphere is selected, preferably, among other things, on the basis of the flange material and glass used. Melting of the sintered body 13 and sealing of the metal tube takes place over a period of time ranging from minutes to up to 36 h. During the often comparatively long period of time, soldering can be supported by means of the melting solder 21, rather than with flux, such that soldering occurs in a flux-free manner.

In order to improve the glass-to-metal bond, it can be of additional advantage to oxidize the exterior surface of the metal tube or tubes 14 prior to or during sealing. The oxide layer thus formed then bonds outstandingly with the glass.

Oxidizing gases, which otherwise are kept from the soldering location by the flux, can, however, oxidize the solder and/or the surfaces to be joined and, furthermore, can degrade the wettability thereof. Soldering can be achieved in a surprisingly simple way by means of protection with a graphite sleeve. However, the graphite sleeve absorbs oxidizing gases of the environment and transforms these in the case of carbon dioxide or oxygen and thus provides for a reducing or at least neutral atmosphere in its interior. The sleeve 25 can at least partially keep away oxidizing gases, in particular, for the entire duration of sealing such that a stabile, impervious soldering is achieved after the hard solder has set during cooling of the leadthrough in the furnace.

Figure 5:
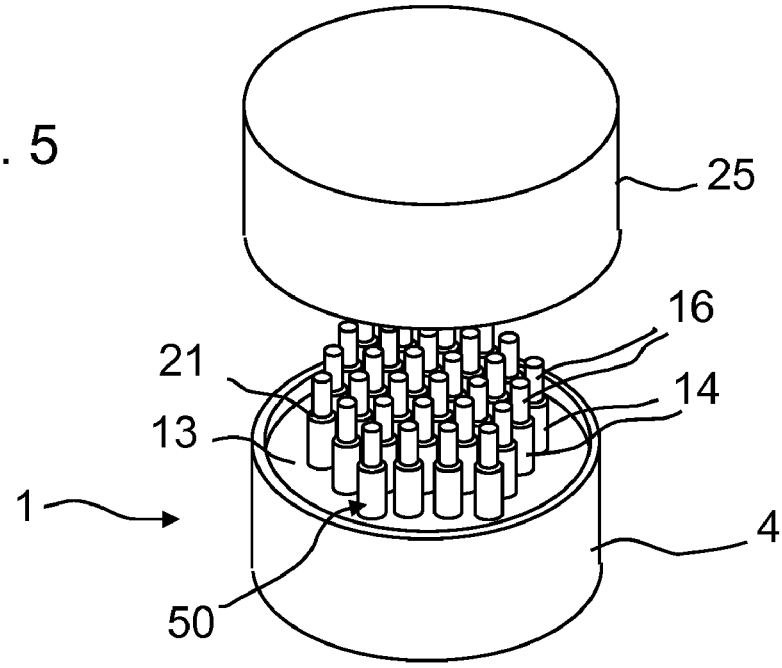

FIG. 5 shows an arrangement for manufacturing an electrical leadthrough having several conductors 50 in a common glass insulator prior to sealing. For this purpose, a glass sintered body 13 having several openings for conductors 50 is inserted in a metal sleeve 4, and the conductors 50 with metal tubes 14 and copper rods 16 inserted in the boreholes. Also in this example, the fillets between the tube ends and the exterior surfaces of the copper rods are provided with hard solder 21 or alternatively are already soldered with hard solder. Unlike in the example shown in FIG. 4, individual conductors are protected not with individual graphite sleeves, but with a common sleeve 25. The sleeve in this case preferably has one borehole for each of the conductors 50, such that as the sleeve 25 is placed on, the metal tubes 14 are inserted into the boreholes and the solder location of the boreholes are enclosed and protected. Subsequently, this arrangement is likewise heated in a furnace under a controlled atmosphere and the glass sintered bodies 13 melted, such that the conductors 50, or the metal tubes 14 thereof, are fused in the glass.

It is obvious to those in the art that the invention, rather than being limited to the aforementioned embodiments, can be varied in multifaceted ways. In particular, the features of the individual example embodiments can also be combined with each other.

The invention claimed is:

1. A method for manufacturing an electrical leadthrough, the method comprising:

providing a metal tube, a metal rod that comprises an electrical leadthrough conductor, and a flange that comprises a borehole;

soldering-in the metal rod into the metal tube;

inserting the metal rod and the metal tube in the borehole of the flange; and fusing the metal tube in a glass insulator;

wherein soldering-in the metal rod into the metal tube is prior to or during the fusing of the metal tube in the glass insulator.

2. The method according to claim 1, characterized in that the metal rod is soldered in the metal tube with hard solder.

3. The method according to claim 1, characterized in that the metal rod is soldered without flux.

4. The method according to claim 1, characterized in that the metal rod is soldered to only one end of the metal tube.

5. The method according to claim 1, characterized in that the metal tube comprises a material having a coefficient of thermal expansion matched to the coefficient of thermal expansion of the glass insulator.

6. The method according to claim 5, characterized in that a metal tube of nickel-iron alloy is fused in the glass insulator.

7. The method according to claim 1, characterized in that the metal rod is a copper or brass rod, which is soldered in the metal tube.

8. The method according to claim 1, characterized by sealing the metal tube in the glass insulator in a controlled gas atmosphere.

9. The method according to claim 8, characterized in that the sealing is carried out in an inert gas atmosphere.

10. The method according to claim 8, characterized in that the sealing is carried out in an oxidizing or reducing atmosphere.

11. The method according to claim 10, characterized in that the cap or sleeve absorbs or transforms oxidizing gases during the sealing.

12. The method according to claim 8, characterized in that a cap or sleeve which protects the soldering location during the sealing is put over the metal tube.

13. The method according to claim 12, characterized in that the cap or sleeve at least partially keeps oxidizing gases away from a fixing location of the metal tube to the metal rod during the sealing.

14. The method according to claim 12, characterized in that the soldering location is protected with a graphite cap or sleeve or a graphite-containing cap or sleeve.

15. The method according claim 12, characterized in that several metal tubes are covered with a common cap.

16. The method according to claim 8, characterized in that an exterior surface of the metal tube is oxidized prior to or during the sealing.

17. The method according to claim 1, wherein the electrical leadthrough is for a pressure tank or safety tank.

18. The method according to claim 17, wherein the safety tank is a reactor safety tank of a nuclear power plant.

19. The method according to claim 8, characterized in that the sealing of the metal tube in the glass insulator is carried out for a duration ranging from one minute to up to 36 hours.

20. The method according to claim 1, characterized in that the metal tube is inserted in a glass-sintered body and the glass-sintered body is melted.

21. The method according to claim 1, characterized in that the metal tube has a fillet weld, to which a rod-shaped conductor is joined by means of soldering.

22. The method according to claim 8, characterized in that glass that constitutes the glass insulator is melted in a metal body of the electrical leadthrough.

23. The method according to claim 22, characterized in that, during the sealing, the metal tube is fixed in alignment to the metal body with at least one alignment element.

24. The method according to claim 1, characterized in that multiple metal tubes are fused in the glass insulator.

25. An electrical leadthrough having at least one conductor sealed in the glass insulator, and comprising the metal tube and the metal rod soldered into the metal tube, the electrical leadthrough being producible according to the method of claim 1.

26. The electrical leadthrough according claim 25, characterized in that the metal tube comprises a metal having a coefficient of temperature expansion matched to a coefficient of temperature expansion of the glass insulator.

27. The electrical leadthrough according to claim 25, characterized in that the metal rod is a copper, brass, or bronze rod.

28. The electrical leadthrough according to claim 25, characterized in that the metal tube and rod are hard-soldered.

29. The electrical leadthrough according to claim 25, characterized by means of a metal body enclosing the glass insulator.

30. The electrical leadthrough according to claim 29, characterized in that glass that constitutes the glass insulator is melted onto the metal body.

31. The electrical leadthrough according to claim 25, characterized in that the soldering location is arranged at a distance of 2-20 millimeters from the glass surface of the glass insulator.

32. The electrical leadthrough according to claim 25, characterized in that the metal tube has a fillet weld, to which a rod-shaped conductor is joined by means of soldering.

33. The electrical leadthrough according to claim 25, having multiple conductors in the glass insulator.

* * * * *